US005280151A

United States Patent [19]

Matsunaga et al.

[11] Patent Number: 5,280,151

[45] Date of Patent: Jan. 18, 1994

[54] METHOD AND APPARATUS FOR DRYING BELTLIKE ARTICLE, AND INDUCTION HEATER HAVING ROTARY DRUMS

[75] Inventors: Tetsuo Matsunaga; Shunji Miyamoto, both of Kanagawa; Tadahiro Takamatsu; Akira Hasegawa, both of Toyama, all of Japan

[73] Assignees: Yoshida Kogyo K.K.; Fuji Electric Co. Ltd., Tokyo, Japan

[21] Appl. No.: 666,379

[22] Filed: Mar. 8, 1991

[30] Foreign Application Priority Data

| | | | |
|---|---|---|---|
| Mar. 8, 1990 | [JP] | Japan | 2-56923 |
| Sep. 6, 1990 | [JP] | Japan | 2-236697 |
| Feb. 21, 1991 | [JP] | Japan | 3-26576 |

[51] Int. Cl.[5] ..... H05B 6/64

[52] U.S. Cl. ..... 219/10.61 A; 219/10.79; 34/1 B

[58] Field of Search ..... 34/1B, 155, 156, 41, 152, 111; 219/10.492, 10.61R, 1061A, 10.79

[56] References Cited

U.S. PATENT DOCUMENTS

| | | | |
|---|---|---|---|
| 159,876 | 2/1875 | Wilder | 34/110 |
| 1,701,156 | 2/1929 | Heritage | 34/1 B X |
| 2,047,372 | 7/1936 | Jalens | 34/110 X |
| 4,005,302 | 1/1977 | Graf et al. | 219/10.61 A |

FOREIGN PATENT DOCUMENTS

| | | | |
|---|---|---|---|
| 629269 | 9/1978 | U.S.S.R. | 34/1 B |

*Primary Examiner*—Henry A. Bennett

*Attorney, Agent, or Firm*—Hill, Steadman & Simpson

[57] ABSTRACT

In drying a beltlike article such as a slide fastener tape by high-frequency induction heating, the tape is wound on the outer circumferential surface of a rotary drum heated from inside while rotating. An induction heating coil is mounted on the outer circumferential surface of a stationary drum, as an inner drum, with a gap with the inner circumferential surface of the rotary drum. The rotary drum is supported at one end by a rotary shaft via an adiabatic material. The stationary inner drum is made of a metal plate having a high heat conductivity for facilitating heat radiation of the heating coil, while the rotary drum is made of a cladding plate including iron and copper plates in combination.

9 Claims, 6 Drawing Sheets

METHOD AND APPARATUS FOR DRYING BELTLIKE ARTICLE, AND INDUCTION HEATER HAVING ROTARY DRUMS

BACKGROUND OF THE INVENTION

1. Field of the Invention

This invention relates generally to a method of and an apparatus for drying a continuous-length beltlike article, such as an elongated strip of cloth, an elongated strip of paper, a slide fastener tape, a surface-type fastener tape, or the like, and an induction heater equipped with rotary drums. More particularly the invention relates to an effective technology to dry such a beltlike article after washed or dyed.

2. Description of the Related Art

Attempts have hitherto been made to dry an elongated beltlike cloth or paper article containing moisture, particularly by heating the beltlike article to evaporate water. To this end it is currently known that hot or heated air is blown out over the beltlike article and that the beltlike article is wound around rotary drums that are heated, for example, by introducing steam into the rotary drums, by placing an electric heater in each rotary drum, or by heating each rotary drum from its outside by electromagnetic induction. These known technologies will now be described specifically with reference to FIGS. 8, 9 and 10.

FIG. 8 shows a prior art apparatus for drying a continuous-length beltlike article (slide fastener tape) 32 with hot air. In this drying apparatus, the beltlike article 32 is continuously fed as wound in a zigzag pattern around several pairs (only one pair are illustrated) obliquely spaced rollers 31, 31 arranged horizontally one pair behind another. Downstream of the roller assembly, a nichrome-wire heater 33 and a fan 34 are located to blow out hot air over the beltlike article 32 in the direction indicated by arrows.

FIG. 9 shows another prior art drying apparatus in which the beltlike article 32 is dried by the heat of a pair of vertically spaced rotary drums 35, 35 heated with steam. During the drying, the beltlike article 32 is wound several times around the two rotary drums 35, 35, and the rotary drums 35, 35 are heated from inside with steam supplied from a steam boiler 36 via a supply pipe 37 and discharged from a discharge pipe 38. Designated by 39 is an adiabatic material covering the supply pipe 37.

FIG. 10 is a side view, with its upper half in cross section, of still another prior art drying apparatus in which a non-illustrated beltlike article is dried by the heat of rotary drums (only one shown) 41 heated from outside by electromagnetic induction heating. FIG. 11 is a fragmentary front view of FIG. 10. During the drying, the non-illustrated beltlike article is wound around the rotary drums 41, whose each shaft is rotatably supported at only one end by a bearing 40. A pair of heating coils 42, 42 are located adjacent to the outer circumferential surface of each rotary drum 41 for induction heating.

However, these prior art technologies have the following disadvantages.

The first-named apparatus is large in entire structure and hence requires an extensive area (e.g., about 15 m in the longitudinal direction) for installation, thus causing a poor thermal efficiency (less than 10%), an increased cost of running, and nonuniform temperature of hot air (varies by plus and minus 20%). For these reasons, the once dyed beltlike article would be discolored on a certain occasion. At the time to start the apparatus, the temperature of hot air would rise very slowly at the time to start the apparatus, requiring a long time to initiate drying operation. At the time to stop the apparatus, it would be lowered very slowly, causing the dyed beltlike article to be overheated and discolored due to thermal inertia.

In the second-named apparatus, the appurtenant work for installation of the steam boiler 36, the adiabatic pipe 37, ect. would be on a large scale, and the individual rotary drum 35 must be in the form of a pressure-resistant vessel, which is burdensome. The joint between the individual pipe 37, 38 and the individual rotary drum 35 is a connecting structure between a fixed part and a rotating part, which structure would be a cause for pressure leakage. Also the cost of facility installation would rise, and the thermal efficiency would be bad, thus remarkedly increasing the running cost. Further, since the facility cannot be moved easily, it is difficult to change the layout of the factory. Even when the heating temperature is to be varied commensurate with the rate of drying process, it is very difficult to control the temperature by the amount of steam supply, and there is a large danger in operation as high-temperature steam is used.

Furthermore, the method for performing induction heating the individual rotary drum from outside is a virtually effective solution to the problems in case of hot air or steam. However, in the induction heating method, since heating is performed locally, both the temperature rise to start the drying operation and the cooling down to stop the drying operation are very slow, and the thermal efficiency also is poor. If the individual rotary drum is heated while it is stopped, only a part of the circumferential surface of the rotary drum is heated, thus causing an irregular thermal distribution and hence distorting the rotary drum 41. Additionally, since the heating coils 42 are located adjacent to the outer circumferential surface of the rotary drum 41, it is difficult to wound the beltlike article around the rotary drum 41.

SUMMARY OF THE INVENTION

It is therefore an object of this invention to provide a beltlike article drying method in which good temperature rising and falling at the start and end of drying and an excellent temperature controlling characteristic can be achieved, thus improving the thermal efficiency and hence reducing the running cost.

Another object of the invention is to provide a beltlike article drying apparatus which is capable of carrying out the described drying method and which is small in size, simple in structure and easy to carry.

Still another object of the invention is to provide an induction heater having rotary drums.

According to a first aspect of the invention, there is provided a method of continuously drying a beltlike article on a rotary drum, comprising: heating an outer circumferential surface of a rotary drum from inside by high-frequency induction heating while rotating the rotary drum; and winding the beltlike article on the outer circumferential surface of the rotary drum.

According to a second aspect of the invention, there is provided an apparatus for drying a beltlike article, comprising: a base plate; a stationary drum fixedly attached to the base plate; a cylindrical rotary drum covering an outer circumferential surface of the stationary drum and having a rotary shaft supported by the base plate; and a high-frequency induction heating coil mounted on the outer circumferential surface of the stationary drum with a gap with an inner circumferential surface of the rotary drum.

According to a third aspect of the invention, there is provided an induction heater of the type having a rotary drum, comprising: a base plate; a thermally conductive stationary drum fixedly attached at one end to the base; a metallic rotary drum covering an outer circumferential surface of the stationary drum via a core and having a rotary shaft supported by the base plate; a heating coil mounted on the outer circumferential surface of the stationary drum with a gap with an inner circumferential surface of the rotary drum.

According to a fourth aspect of the invention, the rotary drum is made of a cladding plate which includes a first metal plate having a high thermal conductivity and a second metal plate having a high magnetic permeability.

According to a fifth aspect of the invention, the heating coil is a split coil composed of a plurality of circumferentially spaced flatwise coils attached on and along the entire outer circumferential surface of the stationary drum, each flatwise coil having a spiral or meandering shape.

According to a sixth aspect of the invention, there is provided an apparatus for drying a slide fastener tape having a pair of fabric portions and a row of interengaged coupling elements, comprising: a base plate; a stationary drum fixedly attached to the base plate; a cylindrical rotary drum covering an outer circumferential surface of the stationary drum for supporting the slide fastener tape in a winding form on an outer circumferential surface of the rotary drum, the rotary drum having a rotary shaft supported by the base plate, the outer circumferential surface of the rotary drum having a plurality of laterally spaced guide grooves each receptive of the slide fastener tape; and a high-frequency induction heating coil mounted on the outer circumferential surface of the stationary drum with a gap with an inner circumferential surface of the rotary drum.

In the first or second aspect of the invention, the individual rotary drum on which a beltlike article is to be wound is heated by high-frequency induction and by hot air or steam, thereby eliminating the prior problems. In this case, the high-frequency induction heating coil (hereinafter called "heating coil") is located inside each rotary drum so that the heating coil can be arranged throughout the entire inner circumferential surface of the rotary drum so as not to obstruct the winding of the beltlike article, thus causing a highly improved thermal efficiency and also realizing the temperature controlling with high precision.

It is necessary to select a suitable value for the frequency of the current flowing in the heating coil with a view to the permeation depth of an induction current. Specically, if the frequency is too high, the induction current concentrates on and around the inner circumferential surface of the individual rotary drum by the skin effect, thus deteriorating the efficiency of drying the beltlike article wound on the outer circumferential surface of the rotary drum. If the frequency is too low, the thermal efficiency and the power factor are lowered. Since the thickness of the individual rotary drum must be increased to a certain extent in view of the permeation depth of the induction current, the weight of the resulting individual rotary drum would be increased, thereby increasing the thermal capacity and hence retarding the temperature rising and falling at the start and end of the drying. This frequency should preferably be 20 to 30 kHz.

In the third aspect of the invention, the heat conduction from each heated rotary drum to the shaft is suppressed by means of an adiabatic material. The heat of the core heated as a side effect is taken to outside the apparatus via a thermally conductive fixed drum so that the heating coil is prevented from being overheated.

In the fourth or fifth aspect of the invention, if a cladding plate is used, the rotary drums can be well heated by induction heating with a metal plate such as iron, which is low in magnetic resistance, while the individual entire rotary drum is uniformly heated with a metal plate such as copper, which is high in thermal conductivity. If a split coil is used, it is possible to facilitate mounting the coil on a large-diameter rotary drum.

The above and other advantages, features and additional objects of this invention will be manifest to those versed in the art upon making reference to the following detailed description and the accompanying drawings in which several preferred embodiments incorporating the principles of this invention are shown by way of illustrative examples.

DETAILED DESCRIPTION

Several embodiments of this invention will now be described with reference to FIGS. 1 through 7. In the illustrated embodiments, a substantially endless-length slide fastener tape (hereinafter also called "tape") is to be dried. The tape has a pair of fabric portions and a row of interengaged coupling elements, as is well known in the art of slide fastener.

Figure 1:
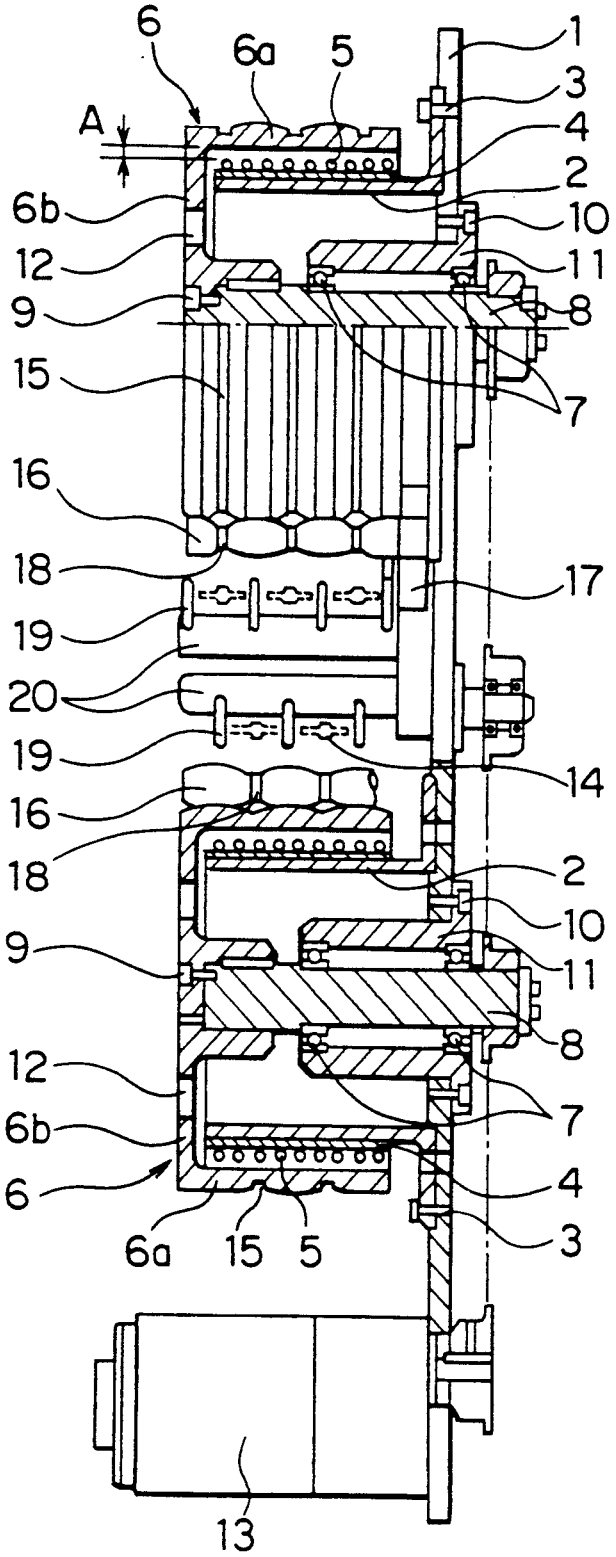
FIG. 1 is a partially cross-sectional side view of a drying apparatus according to a first embodiment of this invention.
Figure 2:
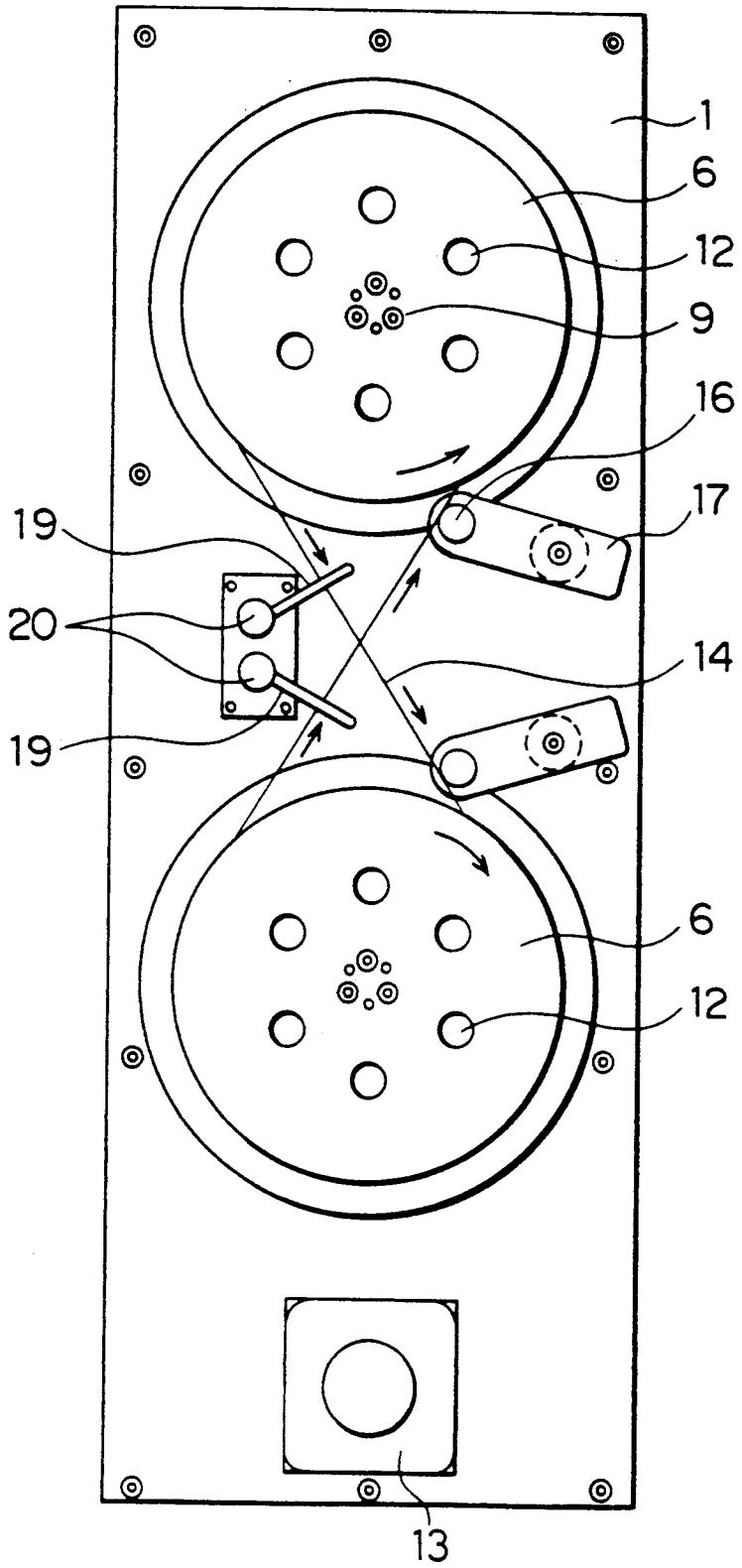
FIG. 2 is a front view of FIG. 1.
Figure 3:
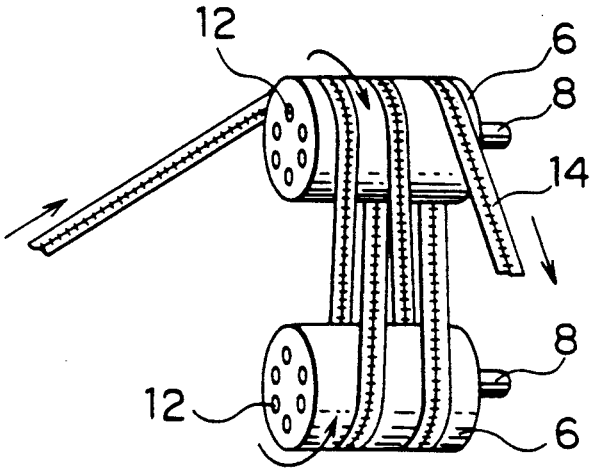
FIG. 3 is a schematic perspective view, on a reduced scale, of FIG. 1.

FIGS. 1 and 2 show a drying apparatus according to the first embodiment of this invention. In FIGS. 1 and 2, reference numeral 1 designates a rectangular base plate vertically fixed to a non-illustrated base by means of screws. A pair of vertically spaced stationary drums 2, 2 of aluminum is fixed at their flanges to the base plate 1 by screws 3, each flange extending outwardly from one end of the respective stationary drum 2. A heating coil 5 is wound around the outer circumferential surface of each stationary drum 2 into a single-layer cylindrical form via a core 4 as of ferrite, which has a high magnetic permeability, so that a current of high frequency ranging from 20 to 30 kHz is supplied from a non-illustrated heating high-frequency inverter.

A pair of rotary drums 6, 6 of stainless steel mesh is put one on each stationary drum 2 from a distal end thereof. Each rotary drum 6 is in the form of a bottomed cylinder which is composed of a tubular drum portion 6*a* and a hubbed support disk 6*b* attached to one open end of the drum portion 6*a* by welding. The individual rotary drum 6 is secured, by secrews 9, to the distal end of a rotary shaft 8 which is horizontally supported by a pair of axially spaced bearings 7, 7. These bearings 7, 7 are held by a sleeve 11 which is secured to the base 1 by screws 10. There is a gap A of 10 to 25 mm between the inner circumferential surface of the drum portion 6*a* and the heating coil 5. Further, the support disk 6*b* has a plurality of vent-holes 12 at equal pitch. Designated by 13 is a motor for driving the rotary drum 6.

Figure 4:
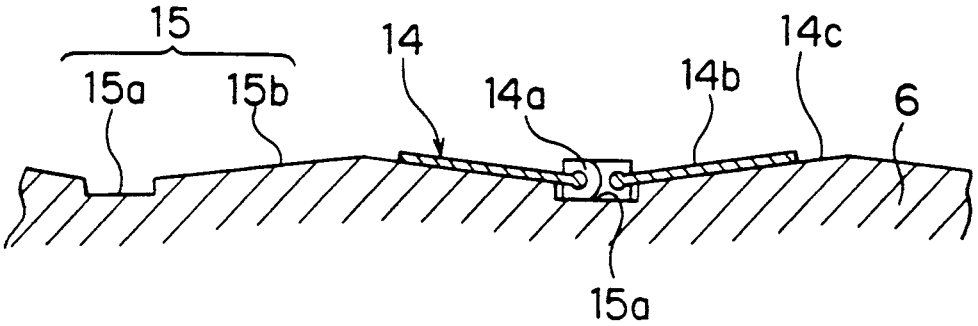
FIG. 4 is an enlarged cross-sectional view of a rotary heating drum of FIG. 1.
Figure 8:
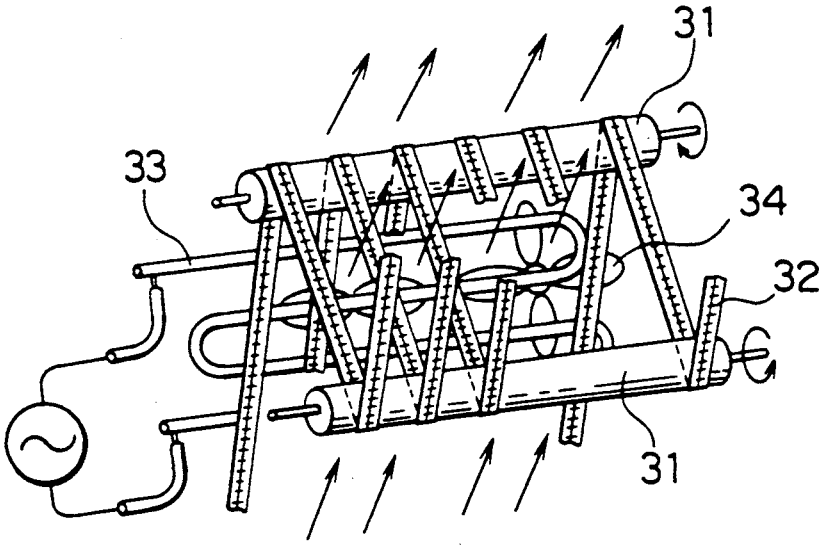
FIG. 8 (PRIOR ART)
FIG. 8 is a schematic perspective view of a first prior art apparatus.
Figure 9:
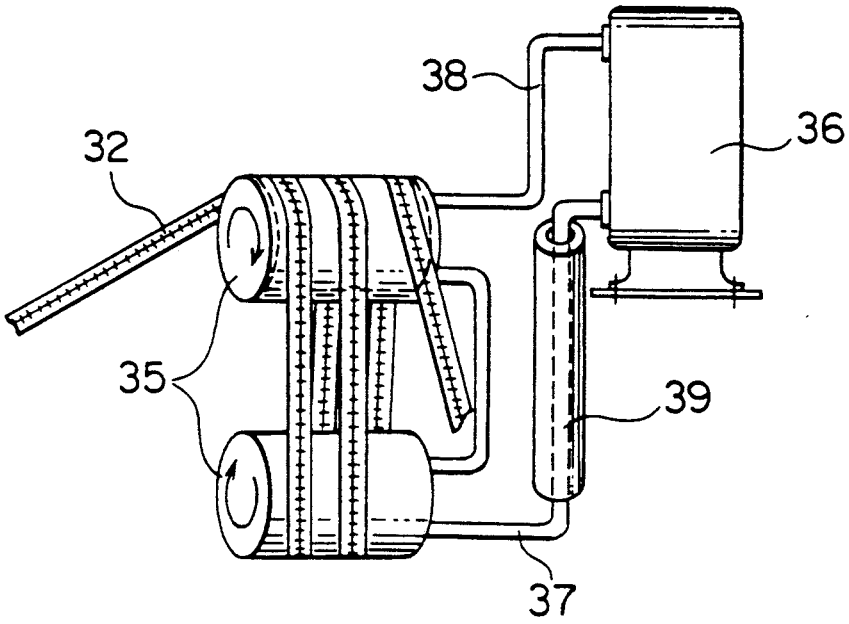
FIG. 9 (PRIOR ART)
FIG. 9 is a schematic perspective view of a second prior art apparatus.
Figure 10:
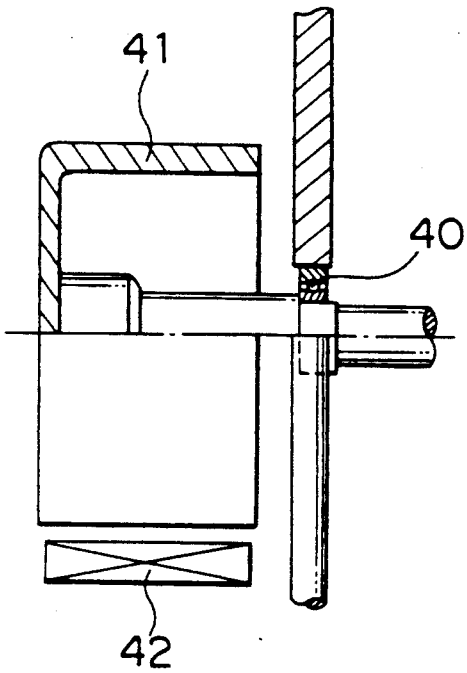
FIG. 10 (PRIOR ART)
FIG. 10 is a side view, with half part in cross section, of a third prior art apparatus.
Figure 11:
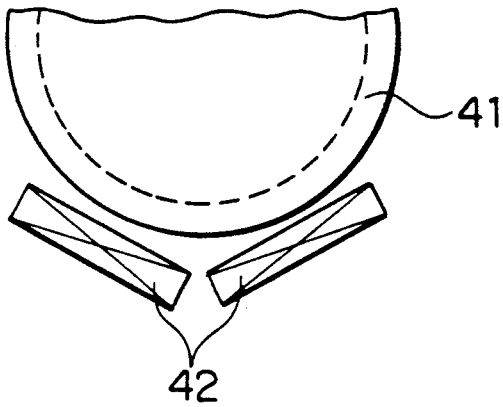
FIG. 11 (PRIOR ART)
FIG. 11 is a fragmentary front view of FIG. 10.

14 designates a tape as an article to be dried. The tape 14 conveyed from the washing and dewatering stage is, as better shown in FIG. 3, wound on the upper rotary drum 6 three times and on the lower rotary drum 6 two times, crossing between the two drums so as to form the FIG. 8. Then the tape 14 is conveyed to the next stage. The upper drum portion 6*a* has on its outer circumferential surface three guide grooves 15 (FIG. 1) commensurate with the number of turns of wings, the shape of each guide groove being complementary with the cross-sectional shape of the tape 14. The lower drum portion 6*a* has two guide grooves 15 identical in shape with those of the upper drum portion 6*a*. During drying, the tape 14 is received in the guide grooves 15 and, at the same time, is guide thereby. FIG. 4 is a fragmentary enlarged view of the individual rotary drum 6, showing in a more specific way the manner in which the tape 14 is received in the guide groove 15. The guide groove 15 is a composite form including a central groove 15*a* of a rectangular cross-sectional shape, and a pair of lateral slope surfaces 15*b*, 15*b* contiguous to the central groove 15*a* on the opposite sides thereof. A row of interenengaged coupling elements 14*a* of the tape 14 is received in the central groove 15*a*, while a pair of fabric portions 14*b*, 14*b* of the tape 14 is in intimate contact with the lateral slope surfaces 15*b*, 15*b*.

In FIGS. 1 and 2 again, reference numeral 16 is a pair of vertically spaced first guide members each fixedly attached to the base plate 1 via a support arm 17 in parallel to the outer circumferential surface of the associated rotary drum 6. The upper first guide member 16, like the upper rotary drum 6, has three guide grooves 18, while the lower first guide member 16, like the lower rotary drum 6, has two guide grooves 18. Further, 19 designates a pair of vertically space rows of second guide members located in confronting relation to the first guide members 16, 16 for keeping spaces between the adjacent tapes 14. The second guide members 19 of each row are mounted on a support rod 20, which is attached to the base plate 1, at regular spaces so that the tape 14 can be received between the adjacent second guide members 19, 19.

In operation, if a high-frequency current is supplied to the heating coil 5 while the rotary drum 6 is in rotation as the motor 13 is started, the individual drum portion 6*a* is heated from inside the drum portion 6*a* by the Joule heat of the current which heat is induced in the rotary drum 6 by the magnetic flux. While it is conveyed in contact with the outer circumferential surface of the drum portion 6*a*, the tape 14 is dried by the conduction heat extending to the outer circumferential surface of the drum portion 6*a*.

With the described arrangement, in which the rotary drum 6 is dried by induction heating, it is possible to perform the temperature control quickly with high precision. And the arrangement is very small in size and simple in structure. It is easy to move if the base is in the form of a push car. In addition, since the heating coil 5 is located inside the rotary drum 6, it is possible to mount each heating coil 5 on the entire inner circumferential surface of the individual drum portion 6*a*, without obstructing the winding of the tape 14, so that the rotary drum 6 can be uniformly heated. Because the use of high-frequency current, following advantageous results can be obtained: (1) Since the thermal efficiency and the electric power factor are good, it is possible to reduce the running cost; (2) Since the number of windings of the heating coil can be minimized, a simple winding structure can be realized; (3) Because the rotary drum 6 can be reduced in thickness and hence in weight due to the reduced permeation depth of the induction current, it is possible to obtain a good temperature rising and falling performance; (4) Because a large gap A can be formed between the heating coil 5 and the inner circumferential surface of the rotary drum 6, it is possible to facilitate the assembling of the apparatus and also to minimize the thermal effect of the rotary drum 6 to the heating coil 5; and (5) Because of good ventilation, temperature falling is performed quickly when controlled to be lowered.

Furthermore, in the illustrated embodiment, since the support disk 6*b* of the rotary drum 6 has vents for allowing exterior air to flow into the rotary drum 6, temperature rising due to thermal inertia is less when the operation of the apparatus is stopped. In the illustrated embodiment, the drum portion 6*a* is also made of stainless steel. Alternatively, the drum portion 6*a* may be made of an adiabatic material such as resin, ceramic or hard rubber to prevent heat conduction to the rotary shaft 8, thus increasing the thermal efficiency and the temperature controlling characteristic. Because the rotary drum 6 has on its outer circumferential surface the guide grooves 15, it is possible to hold the tape 14 accurately with no lateral slipping. More particularly, since the row of interengaged coupling elements 14*a* is received in the rectangular central groove 15*a*, which is deepest, the coupling elements 14*a* can be effectively heated so that core cords 14*c* (FIG. 4), which are most difficult to dry, can be adequately dried by the heat conduction from the coupling elements 14*a*. At that time, since the tape 14 is wound around the upper and lower rotary drums 6, 6 in the figure 8 form (FIGS. 3 and 2), it is possible to increase the area for the tape 14 to contact the rotary drums 6, 6, and it is also possible to heat the opposite surfaces of the tape 14 alternately, thus facilitating the vapor discharge to air and hence causing a more improved drying efficiency.

Figure 5:
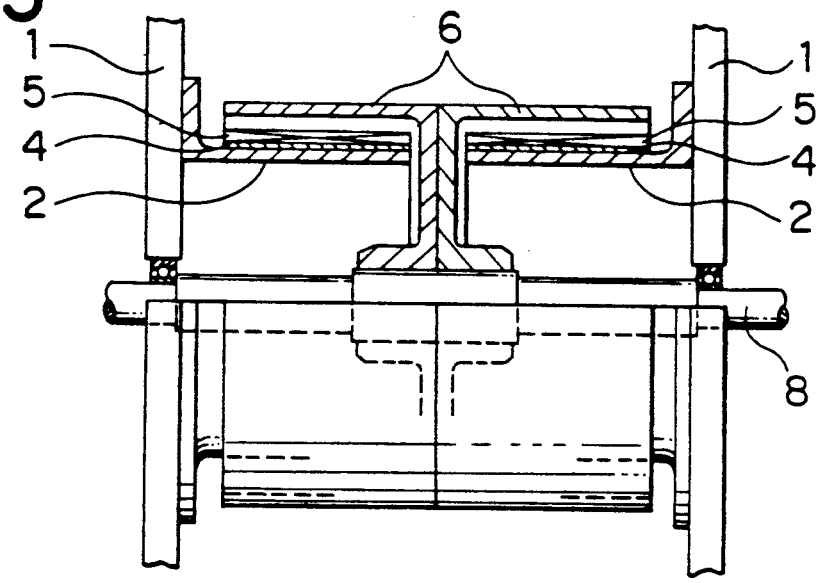
FIG. 5 is a side view, with half part in cross section, of a rotary heating drum according to a second embodiment.
Figure 6:
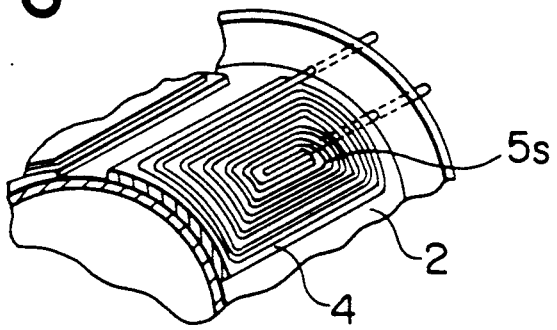
FIG. 6 is a fragmentary cross-sectional view of FIG. 5.

FIGS. 5 and 6 shows a modified apparatus according to the second embodiment of this invention. Specifically, FIG. 5 is a side view, with an upper half in cross section, of the modified apparatus, and FIG. 6 is a fragmentary perspective view of the modified apparatus, showing the drum portion to which the heating coil is attached. Like reference numerals designate similar parts or elements that are identical with or correspond to those of the first embodiment. In the second embodiment, two rotary drums 6, 6 identical with the rotary drum of the first embodiment are located back to back to expand the entire effective outer circumferential surface. For this purpose, the rotary shafts 8, 8 of the two rotary drums 6, 6 are supported at opposite ends by a pair of vertical base plates 1, 1. In this embodiment, as better shown in FIG. 6, the heating coil is a split coil 5*s* composed of a plurality of flatwise coils attached to and along the outer circumferential surface of each rotary drum 6 by an adhesive or a binder via a core 4. Each flatwise coil may have a spiral or meandering shape. These individual flatwise coils 5*s* are interconnected in series and receive the power supply from one and the same power source. Since the remaining construction and operation are substantially identical with those of the first embodiment, their detailed description is omitted here for clarity.

Figure 7:
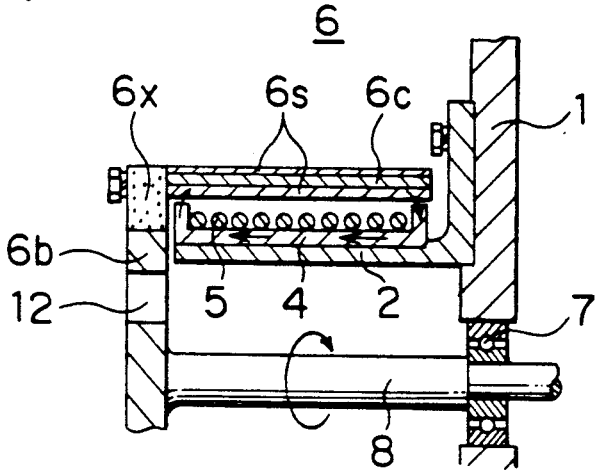
FIG. 7 is a partially cross-sectional side view of a heating drum according to a third embodiment.

FIG. 7 shows another modified apparatus according to the third embodiment of this invention. In the third embodiment, like the first embodiment, a pair of rotary drums 6, 6 (only one shown in FIG. 7) is put one on each stationary drum 2 from a distal end thereof. Each rotary drum 6 is in the form of a bottomed cylinder which is composed of a tubular drum portion described below) and a support disk 6*b* attached to one open end of the drum portion 6*a* in a manner described below. The rotary shaft 8 of each rotary drum 6 is supported at only one end by a bearing 7 fixed to the base plate 1. There is a gap of 10 to 25 mm between the inner circumferential surface of the drum portion 6*a* and the heating coil 5. Further, the support disk 6*b* has a plurality of vent-holes 12 at equal pitch. This embodiment is different from the first embodiment in that the drum portion 6*a* of the rotary drum 6 is made of a cladding plate composed of a pair of stainless steel plates 6*s*, 6*s* having a high magnetic permeability, and a copper plate 6*c* having a high heat conductivity and sandwiched between the stainless steel plates 6*s*, 6*s*. Further, the drum portion 6*a* is supported by the support disk 6*b* via an adiabatic material 6*x* such as ceramic. Using the cladding plate facilitates the induction and the equalization of heat over the entire drum surface. The adiabatic material serves to assist in preventing the heat of the rotary drum 6 from conducting to the rotary shaft 8 and the bearing 7 via the support disk.

According to the first or second aspect of the invention, it is possible to reduce the cost of drying a beltlike article with both reduced cost of installation and improved thermal efficiency. It is also possible to improve the quality of a beltlike article with precise temperature control. Further, since the apparatus is small in size, simple in structure and easy to carry, changes to the factory layout can be made without difficulty. In addition, in the manufacture of slide fastener tapes, which would have been dried in a separate room independently of the remaining processes if they had dried by the prior art apparatus, washing with a cleanser, washing with water, dewatering and drying can take place in a single room from first to last.

According to the third aspect of the invention, it is possible to prevent the heat conduction from the heated rotary drum to the rotary shaft by means of adiabatic material, to take out the heat of core heated as side effect outside the apparatus so as not to heat the heating coil. In the fourth or fifth aspect of the invention, Using the cladding plate facilitates the induction and the equalization of heat over the entire drum surface. The adiabatic material serves to assist in preventing the heat of the rotary drum 6 from conducting to the rotary shaft 8 and the bearing 7 via the support disk.

What is claimed is:

1. An apparatus for drying a beltlike article, comprising:

(a) a base plate;

(b) a stationary drum fixedly attached to said base plate;

(c) a cylindrical rotary drum covering an outer circumferential surface of said stationary drum and having a rotary shaft supported by said base plate; and (d) a high-frequency induction heating coil mounted on the outer circumferential surface of said stationary drum with a gap with an inner circumferential surface of said rotary drum;

wherein said rotary drum further includes a support disk via which said rotary drum is supported on said rotary shaft, said support disk comprising an adiabatic material, and said support disk has a plurality of vents for allowing exterior air to flow into said rotary drum.

2. An apparatus for drying a beltlike article, comprising:

(a) a base plate;

(b) a stationary drum fixedly attached to said base plate;

(c) a cylindrical rotary drum covering an outer circumferential surface of said stationary drum and having a rotary shaft supported by said base plate; and (d) a high-frequency induction heating coil mounted on the outer circumferential surface of said stationary drum with a gap with an inner circumferential surface of said rotary drum;

wherein said heating coil is a split coil composed of a plurality of circumferentially spaced flatwise coils attached on and along the entire outer circumferential surface of said stationary drum, said rotary drum further includes a support disk via which said rotary drum is supported on said rotary shaft, said support disk comprising an adiabatic material, and said support disk has a plurality of vents for allowing exterior air to flow into said rotary drum.

3. An induction heater of the type having a rotary drum, comprising:

(a) a base plate;

(b) a thermally conductive stationary drum fixedly attached at one end to said base;

(c) a metallic rotary drum covering an outer circumferential surface of said stationary drum via a core and having a rotary shaft supported by said base plate;

(d) a heating coil mounted on the outer circumferential surface of said stationary drum with a gap with an inner circumferential surface of said rotary drum;

wherein said rotary drum is made of a cladding plate which includes a first metal plate having a high thermal conductivity and a second metal plate having a high magnetic permeability.

4. An induction heater according to claim 3, wherein said rotary drum further includes a support disk via which said rotary drum is supported on said rotary shaft, said support disk comprising an adiabatic material.

5. An induction heater according to claim 3 wherein said heating coil is a split coil composed of a plurality of circumferentially spaced flatwise coils attached on and along the entire outer circumferential surface of said stationary drum, each of said flatwise coils having a spiral or meandering shape.

6. An apparatus for drying a slide fastener tape having a pair of fabric portions and a row of interengaged coupling elements, comprising:

(a) a base plate;

(b) a stationary drum fixedly attached to said base plate;

(c) a cylindrical rotary drum covering an outer circumferential surface of said stationary drum for supporting the slide fastener tape in a winding form on an outer circumferential surface of said rotary drum, said rotary drum having a rotary shaft supported by said base plate, the outer circumferential surface of said rotary drum having a plurality of laterally spaced guide grooves each receptive of the slide fastener tape; and (d) a high-frequency induction heating coil mounted on the outer circumferential surface of said stationary drum with a gap with an inner circumferential surface of said rotary drum.

7. A slide fastener tape drying apparatus according claim 6, wherein each said guide groove includes a rectangular central groove for receiving the row of interengaged coupling elements, and a pair of laterally spaced of lateral slope surfaces contiguous to said central groove on opposite sides thereof for supporting the pair of fabric portions in intimate contact therewith.

8. A slide fastener tape drying apparatus according to claim 5, further including a first guide member attached to said base plate, and a row of laterally spaced second guide members located in confronting relation to said first guide member, said first guide member having a plurality of laterally spaced guide grooves located in confronting relation to said guide grooves of said rotary drum, said second members being spaced at regular distances for receiving the slide fastener tape therebetween.

9. An induction heater of the type having a rotary drum, comprising:

(a) a base plate;

(b) a thermally conductive stationary drum fixedly attached at one end to said base;

(c) a metallic rotary drum covering an outer circumferential surface of said stationary drum via a core and having a rotary shaft supported by said base plate;

(d) a heating coil mounted on the outer circumferential surface of said stationary drum with a gap with an inner circumferential surface of said rotary drum;

wherein said heating coil is a split coil composed of a plurality of circumferentially spaced flatwise coils attached on and along the entire outer circumferential surface of said stationary drum, each of said flatwise coils having a spiral or meandering shape, said induction heater further including a first guide member attached to said base plate, and a row of laterally spaced second guide members located in confronting relation to said first guide member, said first guide member having a plurality of laterally spaced guide grooves located in confronting relation to said guide grooves of said rotary drum, said second members being spaced at regular distances for receiving the slide fastener tape therebetween.

* * * * *